US005970289A

United States Patent [19]

Yoo

[11] Patent Number: 5,970,289

[45] Date of Patent: Oct. 19, 1999

[54] APPARATUS FOR ELIMINATING EXCESS IONS OF A DEVELOPER FOR LIQUID ELECTROPHOTOGRAPHIC PRINTER

[75] Inventor: Yong-baek Yoo, Suwon, Rep. of Korea

[73] Assignee: Samsung Electronics Co., Ltd., Kyungki-do, Rep. of Korea

[21] Appl. No.: 09/255,717

[22] Filed: Feb. 23, 1999

[30] Foreign Application Priority Data

Feb. 26, 1998 [KR] Rep. of Korea ..... 98-6135

[51] Int. Cl.[6] ..... G03G 15/10

[52] U.S. Cl. ..... 399/237

[58] Field of Search ..... 399/237, 238, 399/57, 241; 361/212, 214, 215, 220

[56] References Cited

U.S. PATENT DOCUMENTS 5,752,143 5/1998 Wayman ..... 399/248

*Primary Examiner*—Matthew S. Smith
*Assistant Examiner*—Greg Moldafsky
*Attorney, Agent, or Firm*—Sughrue, Mion, Zinn, Macpeak & Seas, PLLC

[57] ABSTRACT

An apparatus for eliminating excess ions in a developer used for a liquid electrophotographic printer, including a photoreceptor medium, a laser scan unit for forming an electrostatic latent image by emitting a laser beam to the photoreceptor medium, and a developing unit for developing an electrostatic latent image area of the photoreceptor medium using a developer which is a mixture of a toner and a liquid carrier. The apparatus includes: a settling unit provided at one side of the developing unit for settling the toner of the developer supplied from the developing unit in a short time using an electrical force; a developer input/output controller installed between the developing unit and the settling unit for selectively controlling the input/output of the developer; and an excess ion eliminating unit for eliminating excess ions included in the developer in an upper portion of the settling unit. Thus, in the apparatus for eliminating excess ions in a developer, the developer flows sporadically in the settling tank from the developing unit during operation of a printer. The toner in the developer flowed in is settled in a short time by applying a bias voltage to upper and lower electrode plates of the settling unit. Then, the excess ions included in the developer disposed in the upper portion of the settling tank where the settlement of toner is sufficiently made are eliminated. Thus, in a liquid electrophotographic printer adopting the above apparatus according to the present invention, a decrease in the concentration of toner on an image can be prevented.

8 Claims, 4 Drawing Sheets

APPARATUS FOR ELIMINATING EXCESS IONS OF A DEVELOPER FOR LIQUID ELECTROPHOTOGRAPHIC PRINTER

BACKGROUND OF THE INVENTION

1. Field of the Invention

The present invention relates to a liquid electrophotographic printer, and more particularly, to an apparatus for eliminating excess ions in a developer used for a liquid electrophotographic printer so that a decrease in the concentration of toner on an image can be prevented.

2. Description of the Related Art

In a general liquid electrophotographic printer, an image recording surface of a photoreceptor medium such as a photoreceptor belt or photoreceptor drum is electrically charged. Light is selectively scanned on the image recording surface so that the level of electrical potential varies and an electrostatic latent image is formed. Then, charged developer adheres to the electrostatic latent image to form an image.

FIG. 1 shows a general liquid electrophotographic printer. Referring to the drawing, the liquid electrophotographic printer includes a photoreceptor belt 14 which is operated by being supported by a driving roller 11, a transfer backup roller 12, and a steering roller 13, a laser scan unit 30 for emitting a laser beam onto the photoreceptor belt 14 according to an image signal to form an electrostatic latent image, and a developing unit 40 for developing the electrostatic latent image by adhering a developer to the electrostatic latent image.

In the case of a color printer, a plurality of laser scan units 30 for forming electrostatic latent images corresponding to colors, i.e., yellow (Y), magenta (M), cyan (C), and black (B) images, and a plurality of developing units 40 for developing the electrostatic latent image for each color are installed.

The electrostatic latent image of the previous step is removed as the photoreceptor belt 14 passes through an eraser 15. The photoreceptor belt 14 is charged to a predetermined uniform electrical potential at a corona unit 20. The laser scan unit 30 emits a laser beam and selectively lowers the electrical potential of the surface of the photoreceptor belt 14, i.e, the image recording surface, so that an electrostatic latent image is formed. Thus, a predetermined difference in electrical potential is generated between the electrostatic latent image and its surroundings on the photoreceptor belt 14.

The developing unit 40 develops the electrostatic latent image by attaching a developer including toner of a predetermined color to the image record surface of the photoreceptor belt 14 where the electrostatic latent image is formed. That is, when the developer including toner of a predetermined color and liquid carrier is supplied to the image recording surface of the photoreceptor belt 14, the developer selectively adheres to an area where the electrostatic latent image is formed due to the difference in electric potential.

As the photoreceptor belt 14 is operated, the liquid carrier of the developer attached to the position of the electrostatic latent image is absorbed and removed by a drying roller 71 and only toner particles are left at the position of the electrostatic latent image on the photoreceptor belt 14. The toner particles, i.e., a color image, is transferred to a transfer roller 73 installed to face the transfer backup roller 12. The transferred image is printed on a print medium 80, such as a sheet of paper, passing between the transfer roller 73 and the press roller 77. The image printed on the print medium 80 is fixed by an additional fixing unit (not shown).

As shown in FIG. 2, the developing unit 40 adopted in the above liquid electrophotographic printer is installed under the photoreceptor belt 14. The developing unit 40 includes a developing receptacle 42, in which a developing roller 41 and a squeeze roller 43 are installed close to the photoreceptor belt 14, and a mixing tank 45 in which a developer 47, which is a mixture of toner of a predetermined color and liquid carrier, is maintained at an appropriate concentration.

The developer 47 of appropriate concentration is contained in the mixing tank 45. The concentration of the developer 47 can be controlled by mixing a developer appropriately supplied from an ink vessel (not shown) where a developer of high concentration is contained and a carrier appropriately supplied from a carrier vessel (not shown) where a liquid carrier is contained. The developer 47 is pumped by a pump 48 toward the developing roller 41 through a developer supply pipe 49. Here, the toner of the developer 47 is charged to a predetermined electric potential.

The developing roller 41, as shown in FIG. 3, is rotated in the same direction as the photoreceptor belt 14, being separated by a developing gap (G) from the photoreceptor belt 14. According to rotation of the developing roller 41, the developer 47 supplied between the developing roller 41 and the photoreceptor belt 14 through the developer supply pipe 49 is attached to an electrostatic latent image area (A) of the photoreceptor belt 14. Here, since the electric potential of the electrostatic latent image area (A) is lower than the surroundings, as described above, the developer 47, particularly, toner having a predetermined electric potential, selectively adheres to the electrostatic latent image area (A). The squeeze roller 43 presses the developer 47 attached to the electrostatic latent position (A) and presses the toner close to the photoreceptor belt 14, while squeezing the liquid carrier.

The rest of the developer 47 which is not adhered to the electrostatic latent image position (A) of the photoreceptor belt 14 is collected in the developing receptacle 42. The collected developer is fed back to the mixing tank 45 and reused.

However, ions in the developer 47 increase in number as the developer repeats the reuse process. That is, the ratio (% FPC) of bulk conductivity of a developer including a liquid carrier and toner to free phase conductivity of a developer excluding the toner, i.e, the liquid carrier, increases. The excess ions, particularly cations, adhere to the electrostatic latent image area during development of the electrostatic latent image. Accordingly, the amount of toner adhering to the electrostatic latent image area decreases so that the intensity of the image decreases.

SUMMARY OF THE INVENTION

To solve the above problems, it is an objective of the present invention to provide an apparatus for eliminating excess ions in a developer used for a liquid electrophotographic printer so that a decrease in the concentration of toner on an image can be prevented.

Accordingly, to achieve the above objective, there is provided an apparatus for eliminating excess ions in a developer used for a liquid electrophotographic printer, including a photoreceptor medium, a laser scan unit for forming an electrostatic latent image by emitting a laser beam to the photoreceptor medium, and a developing unit for developing an electrostatic latent image area of the photoreceptor medium using a developer which is a mixture of a toner and a liquid carrier, the apparatus including: a settling unit provided at one side of the developing unit for settling the toner of the developer supplied from the developing unit in a short time using an electrical force; a developer input/output controller installed between the developing unit and the settling unit for selectively controlling the input/output of the developer; and an excess ion eliminating unit for eliminating excess ions included in the developer in an upper portion of the settling unit. Thus, in the apparatus for eliminating excess ions in a developer, the developer flows sporadically in the settling tank from the developing unit during operation of a printer. The toner in the developer flowed in is settled in a short time by applying a bias voltage to the upper and lower electrode plates.

It is preferred in the present invention that the settling unit comprises a settling tank for containing the developer supplied from the developing unit and having upper and lower electrode plates respectively at upper and lower portions thereof, and a power supply unit for selectively applying a bias voltage to the upper and lower electrode plates to improve the speed of settlement of toner included in the settling tank.

It is preferred in the present invention that the apparatus for eliminating excess ions in a developer used for a liquid electrophotographic printer further comprises a plurality of conductive balls in the settling tank.

It is preferred in the present invention that the excess ion eliminating unit comprises first and second electrode members installed to be spaced a predetermined distance from each other and such that at least parts thereof can be submerged in the developer disposed in the upper portion of the settling unit, and a power supply, electrically connected to the first and second electrode members, for selectively supplying electric current to the first and second electrode members.

It is also preferred in the present invention that a vessel is installed at one side of the settling unit such that the developer disposed in the upper portion of the settling unit can be input and output, and parts of the first and second electrode members are installed to be submerged in the developer included in the vessel.

It is also preferred in the present invention that the developer input/output controller comprises a first valve which is selectively opened/closed such that the developer in the developing unit can be moved into the settling unit and a second valve which is selectively opened/closed such that the developer in the settling unit can be returned to the developing unit.

It is also preferred in the present invention that the developer input/output controller further comprises a pump which is selectively operated to return the developer in the settling unit to the developing unit.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 4:
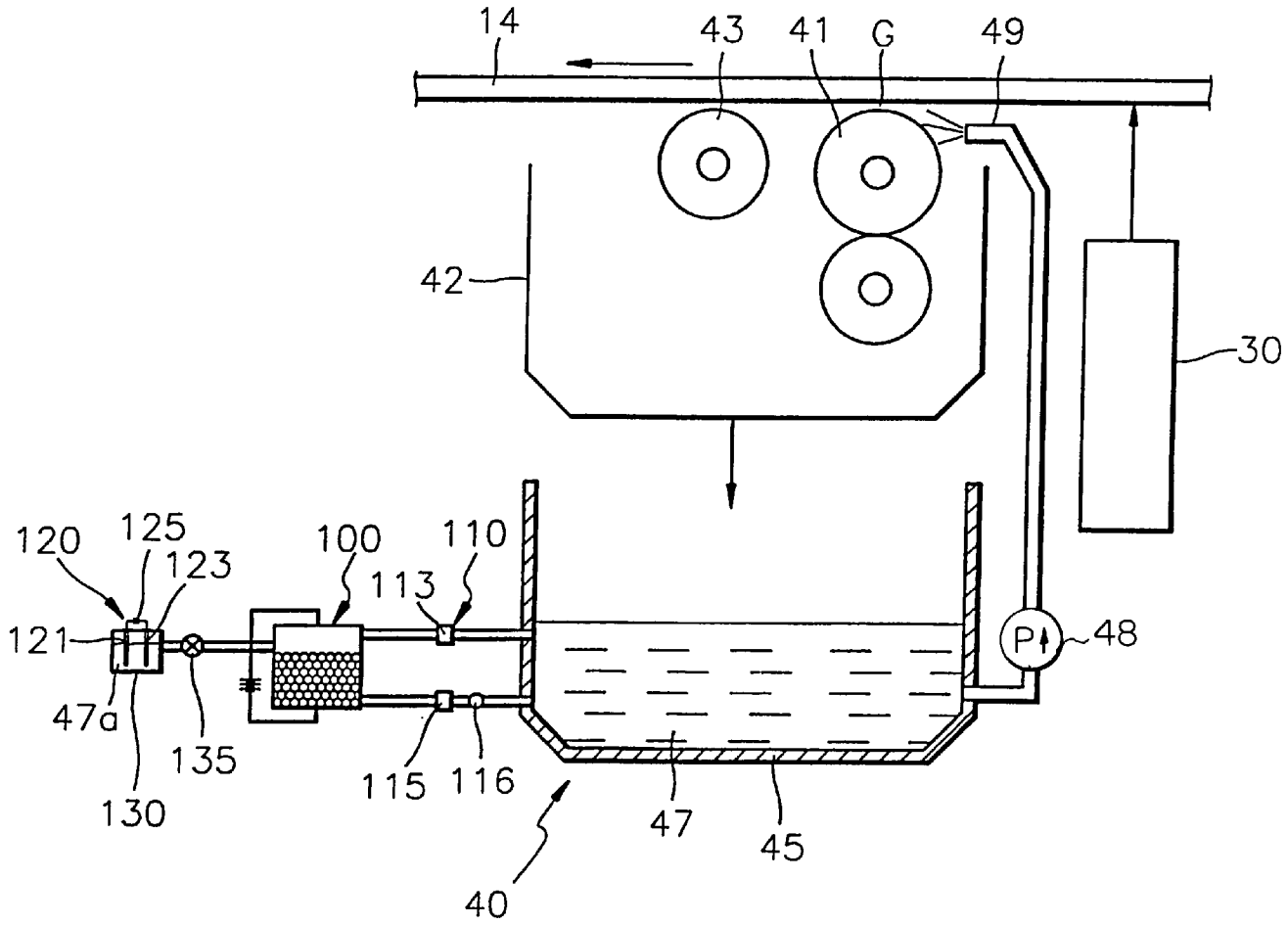
FIG. 4 is a view showing an apparatus for eliminating excess ions in a developer used for a liquid electrophotographic printer according to a preferred embodiment of the present invention.

Referring to FIG. 4, an apparatus for eliminating excess ions in a developer according to a preferred embodiment of the present invention comprises a settling unit 100 provided at one side of a developing unit 40, a developer input/output controller 110 provided between the developing unit 40 and the settling unit 100 for selectively controlling the input/output of the developer, and an excess ions eliminating unit 120 for eliminating excess ions included in the developer in the upper portion of the settling unit 100. Here, the same reference numerals as those in FIGS. 1 and 2 indicate the same elements having the same functions.

Figure 5:
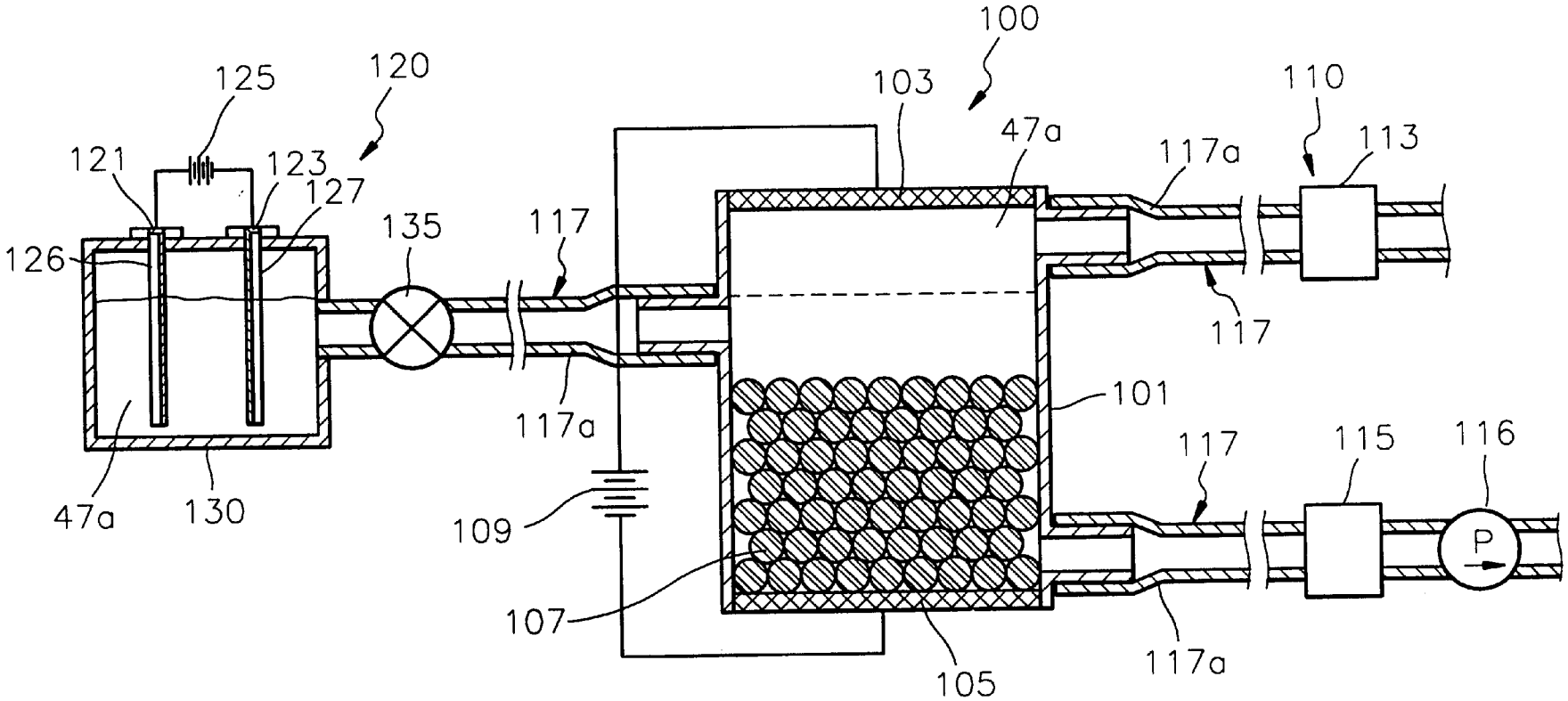
FIG. 5 is a magnified view of the excess ion eliminating apparatus of FIG. 4.

The settling unit 100 is provided to settle toner of a developer supplied from the developing unit 40 in a short time using an electrical force. The settling unit 100, as shown in FIG. 5, comprises a settling tank 101 containing a developer supplied from the developing unit 40 and a power supply unit 109 for selectively applying a bias voltage.

The settling tank 101 is provided with upper and lower electrode plates 103 and 105 at the upper and lower portions thereof, respectively. The power supply unit 109 selectively applies a bias voltage between the upper electrode plate 103 and the lower electrode plate 105. Here, since toner is charged with cations, for example, the positive pole and the negative pole of the power supply unit 109 are electrically connected to the upper electrode plate 103 and the lower electrode plate 105, respectively.

In a state in which the settling tank 101 is completely filled with developer, when a bias voltage is applied from the power supply unit 109 to the upper and lower electrode plates 103 and 105 of the settling tank 101, an electrical field is formed in the settling tank 101 and positively charged toner is moved downward to the lower electrode plate 105 due to electrical attraction so that the speed of settlement of toner increases. Thus, the settlement of toner is done within short time. Here, the time of the settlement of toner varies according to the bias voltage applied and the distance between the upper and lower electrode plates 103 and 105.

Preferably, a plurality of conductive balls 107 are provided in the settling tank 101. The conductive balls 107 are stacked in multiple layers and in alternating form on the lower electrode plate 105, as shown in FIG. 5. Thus, the conductive balls 107 are electrically connected to the lower electrode plate 105.

As a result, the conductive balls 107 vary the distance between the upper electrode plate 103 and the lower electrode plate 105. That is, an effective distance between the upper and lower electrode plates 103 and 105 becomes narrower due to the stack height of the conductive balls 107. In the case in which the conductive balls 107 are provided, since there is a space between the conductive balls 107, the capacity of the settling tank 105 containing developer becomes larger while the effective distance between the upper and lower electrode plates 103 and 105 becomes narrower.

Also, since toner can be attached to the outer circumferential surfaces of the conductive balls 107, the effective contact area between the toner to be settled and the lower electrode plate 105 becomes larger. Thus, a decrease in the electrical attraction due to an insulation effect by the toner settled and accumulated on the lower electrode plate 105, which occurs when the conductive balls 107 are not provided, can be reduced.

In the settling unit 100 having the above structure, the rate at which toner settles increases as the applied voltage increases up to a predetermined voltage. It has been confirmed through experiments that, above the predetermined voltage, a vortex is generated during the settlement of toner. For example, when the distance between the upper and lower electrode plates 103 and 105 is about 30 mm and about half the settling tank 101 is filled with the conductive balls 107, the speed of settlement increases as the bias voltage increases up to 1 kV. When a bias voltage of about 1 kV is applied, it has also been confirmed that settlement of toner takes about ten minutes. Meanwhile, when a bias voltage beyond the predetermined voltage, e.g., 1 kV–7 kV, is applied, a vortex is generated during the settlement of toner. Here, it is noted that the above values indicate an example of operation of the settling unit 100 according to the present invention.

A portion 117*a* of each of three developer paths 117 connected to the settling tank 101, which has a predetermined length and is located near the settling tank 101, is made flexible. Accordingly, the settling tank 101 can be shaken to remove the toner from the outer circumferential surfaces of the conductive balls 107 and the lower electrode plate 105. Thus, the toner in the settling tank 101 can be easily collected and returned to the developing unit 40.

The developer input/output controller 110 includes first and second valves 113 and 115 which are selectively opened/closed. The first valve 113 is selectively opened/closed such that a developer of the developing unit 40 can move to the settling tank 101. The second valve 115 is selectively opened/closed such that the developer of the settling tank 101 can be fed back to the developing unit 40. Here, a solenoid valve can be used as the respective first and second valves 113 and 115.

When the developer input/output controller 110 is provided as above, the upper electrode plate 103 of the settling tank 101 is preferably positioned to be lower than the level of the developer in the developing unit 40. Under these circumstances, when the first valve 113 is open, the developer in the developing unit 40 flows of itself toward the settling tank 101 to completely fill the settling tank 101.

The developer input/output controller 110, as shown in the drawing, is preferably provided with a pump 116 between the one side of the second valve 115 and the developing unit 40. The pump 116 is selectively operated such that the developer in the settling tank 101 can be returned to the developing unit 40.

Here, it is possible to provide the pump 116 only instead of the second valve 115.

In the present invention, the developer input/output controller 110 can be provided with a pump (not shown) operated sporadically and capable of pumping bidirectionally.

The excess ion eliminating unit 120 eliminates excess ions included in a developer in the settling tank 101, that is, a developer 47*a* in the upper portion of the settling tank 101, in a state in which toner is sufficiently settled. For this purpose, the excess ion eliminating unit 120, as shown in FIG. 5, comprises first and second electrode members 121 and 123 installed to be spaced a predetermined distance from one another and such that at least parts thereof can be submerged in the developer 47*a* disposed in the upper portion of the settling tank 101, and a power supply 125 electrically connected to the first and second electrode members 121 and 123 for selectively supplying electric current.

The first and second electrode members 121 and 123 are conductive flat electrodes formed on the surfaces of first and second arms 126 and 127, facing each other. The first and second electrode members 121 and 123 are electrically connected to the power supply 125. The power supply 125 selectively applies direct current (DC) between the first and second electrode members 121 and 123.

In the present preferred embodiment, a vessel 130 is installed at one side of the settling tank 101 so that the developer 47*a* of the upper portion of the settling tank 101 can be moved in and out. The first and second arms 126 and 127, i.e., the first and second electrode members 121 and 123, are installed such that parts thereof can be submerged in the developer 47*a* contained in the vessel 130. Preferably, the first and second electrode members 121 and 123 are extended to near the bottom surface of the vessel 130 to eliminate excess ions when a small amount of developer is contained in the vessel 130. Here, a valve 135 for controlling flow of the developer 47*a* is preferably provided between the settling tank 101 and the vessel 130.

The valve 135 is maintained closed until the developer moved in the settling tank 101 from the developing unit 40 is sufficiently settled. After a predetermined time when the settlement of the developer is fully achieved, the valve 135 is opened so that the developer 47*a* disposed in the upper portion of the settling tank 101, i.e., a liquid carrier mainly including excess ions, can flow into the vessel 130.

Figure 1:
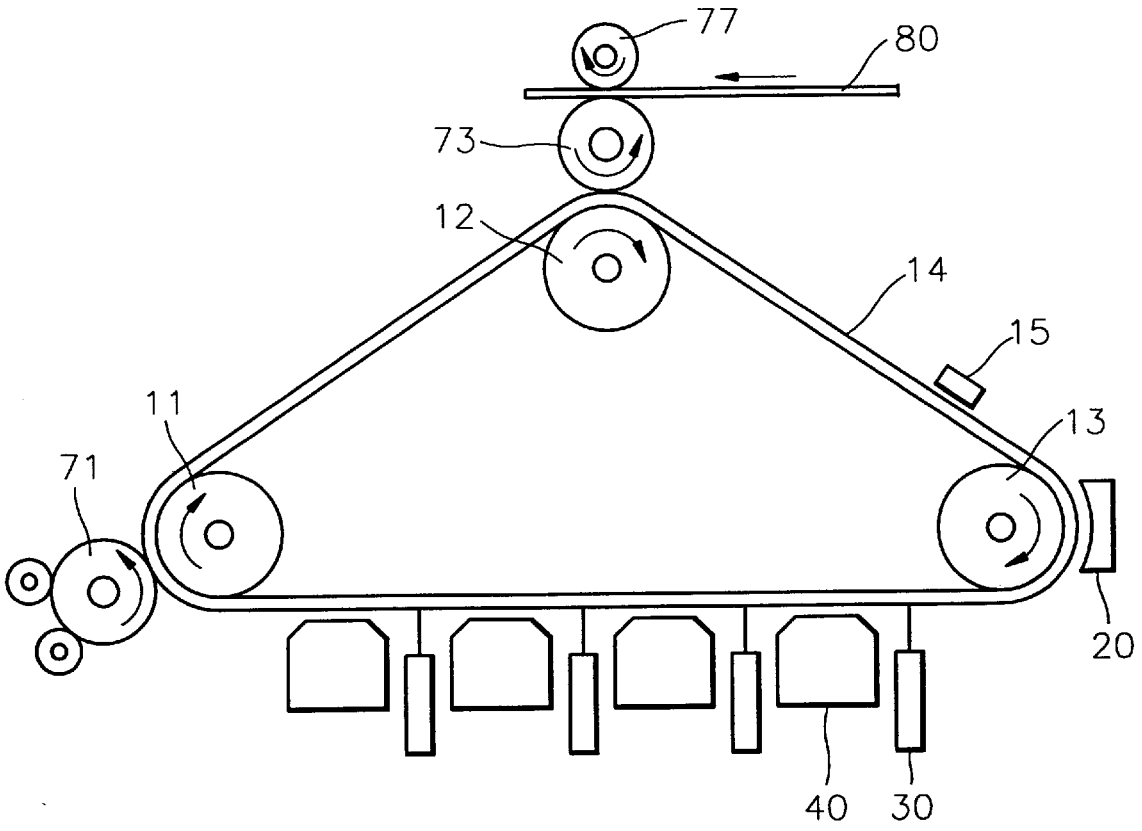
FIG. 1 (PRIOR ART)
FIG. 1 is a view showing a general liquid electrophotographic printer.
Figure 2:
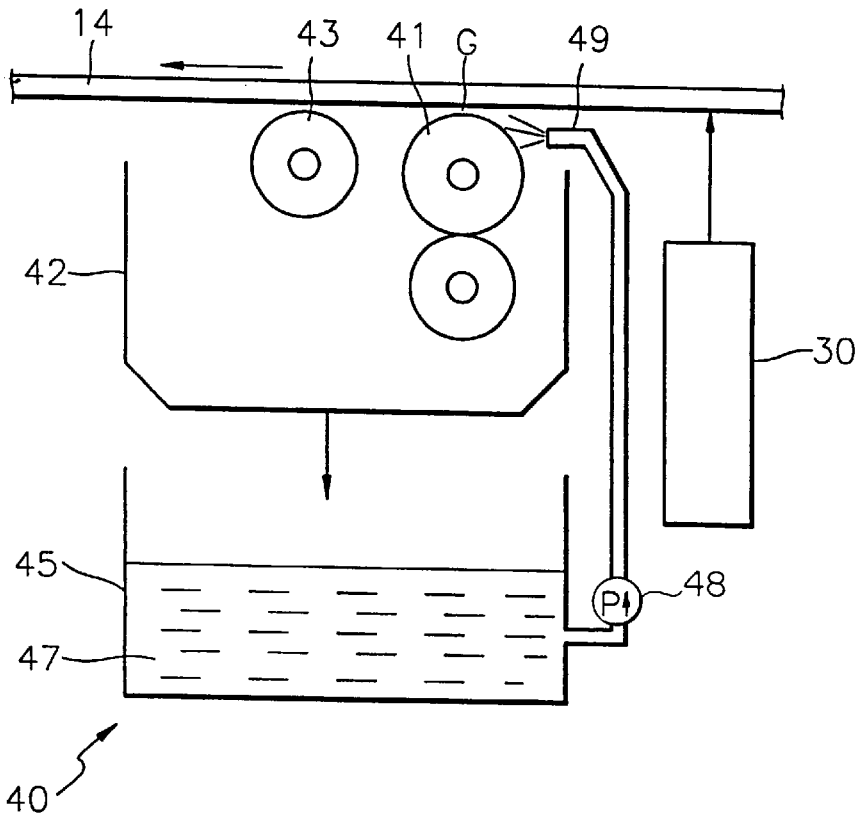
FIG. 2 (PRIOR ART)
FIG. 2 is a view showing the structure of a developing unit shown in FIG. 1.
Figure 3:
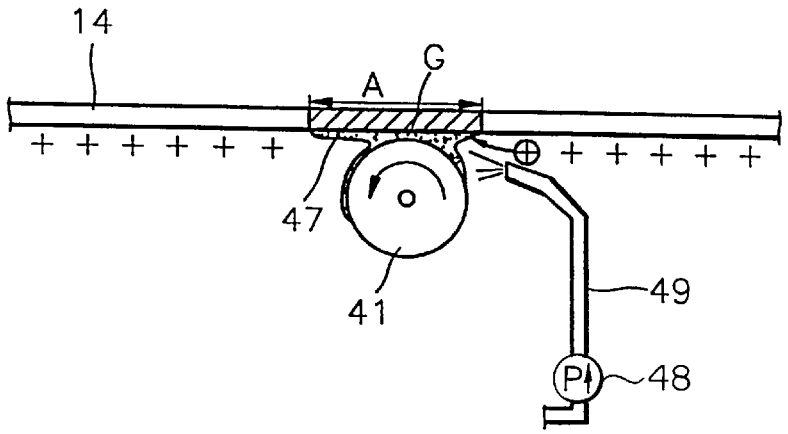
FIG. 3 (PRIOR ART)
FIG. 3 is a view showing a developing roller shown in FIG. 1.

The operation of the apparatus for eliminating excess ions in a developer used for a liquid electrophotographic printer according to a preferred embodiment of the present invention will be described with reference to FIGS. 1, 4 and 5.

First, when the first valve 113 of the developer input/output controller 110 is open, the developer 47 flows in the settling tank 101 from the mixing tank 45 of the developing unit 40. Here, the valves 115 and 135 are all closed. When the settling tank 101 is completely filled with the developer 47, the first valve 113 is closed and the developer 47 is prevented from moving in and out between the mixing tank 45 and the settling tank 101.

When the first valve 113 is closed, the power supply unit 109 is operated to apply a predetermined bias voltage between the upper and lower electrode plates 103 and 105 of the settling tank 101. The settlement of toner of the developer is made in a short time due to the bias voltage.

After sufficient time has passed to settle the developer in the settling tank 101, for example, several minutes, the valve 135 is opened and accordingly the developer 47*a* disposed in the upper portion of the settling tank 101 flows into the vessel 130. Here, the level of the developer in the settling tank 101 becomes the same as that of the developer in the vessel 130, i.e, a liquid carrier. (The dashed line of FIG. 5 indicates the level of the developer in the settling tank 101 after the developer flows into the vessel 130.) The power supply 125 supplies direct current (DC) to the first and second electrode members 121 and 123. Thus, the excess ions included in the developer 47*a*, i.e., the liquid carrier, for example, cations, are eliminated by being attached to the second electrode member 123.

When the excess ions are somewhat eliminated after a predetermined time, the second valve 115 is opened and the developer contained in the settling tank 101 and the vessel

130 is returned to the developing unit 40. Then, the valves 115 and 135 are all closed.

Also, to continuously operate the excess ion elimination process, the first valve 113 is opened again and the developer 47 in the developing unit 40 flows into the settling tank 101 and the above process is repeated.

Here, since the developer 47*a* in which toner particles are sufficiently settled flows into the vessel 130, the toner particles hardly adhere to the surfaces of the first and second electrode members 121 and 123.

The above excess ion elimination process is continuously performed during use of the printer.

As described above, in the apparatus for eliminating excess ions in a developer according to the present invention, the developer flows sporadically in the settling tank from the developing unit during operation of a printer. The toner in the developer flowed in is settled in a short time by applying a bias voltage to the upper and lower electrode plates. Then, the excess ions included in the developer disposed in the upper portion of the settling tank where the settlement of toner is sufficiently made are eliminated by applying a current to the first and second electrode members. Thus, in a liquid electrophotographic printer adopting the above apparatus according to the present invention, a decrease in the concentration of toner on an image can be prevented.

Also, the apparatus for eliminating excess ions in a developer as above, adopting a settling tank which is sporadically opened and closed, can eliminate excess ions during the operation of the printer. Further, since toner can be settled in a short time by applying a bias voltage to the upper and lower electrode plates of the settling tank, the process of eliminating excess ions can be efficiently performed.

What is claimed is:

1. An apparatus for eliminating excess ions in a developer used in a liquid electrophotographic printer, including a photoreceptor medium, a laser scan unit for forming an electrostatic latent image by emitting a laser beam to said photoreceptor medium, and a developing unit for developing an electrostatic latent image area of said photoreceptor medium using a developer which is a mixture of a toner and a liquid carrier, said apparatus comprising:

a settling unit provided at one side of said developing unit for settling the toner of the developer supplied from said developing unit in a short time using an electrical force;

a developer input/output controller installed between said developing unit and said settling unit for selectively controlling the exchange of the developer between said developing unit and said settling unit; and an excess ion eliminating unit for eliminating excess ions included in the developer in an upper portion of said settling unit.

2. The apparatus as claimed in claim 1, wherein said settling unit comprises:

a settling tank for containing the developer supplied from said developing unit and having upper and lower electrode plates respectively at upper and lower portions of said settling tank; and a power supply unit for selectively applying a bias voltage to said upper and lower electrode plates to improve the speed of settlement of the toner included in said settling tank.

3. The apparatus as claimed in claim 2, further comprising a plurality of conductive balls in said settling tank.

4. The apparatus as claimed in claim 1, wherein said excess ion eliminating unit comprises:

first and second electrode members installed a predetermined distance from each other and such that at least parts of said first and second electrode members are submerged in the developer disposed in the upper portion of said settling unit; and a power supply, electrically connected to said first and second electrode members, for selectively supplying electric current to said first and second electrode members.

5. The apparatus as claimed in claim 4, wherein a vessel is installed at one side of said settling unit such that the developer disposed in the upper portion of said settling unit is exchanged between the said settling unit and said vessel, and parts of said first and second electrode members are submerged in the developer included in said vessel.

6. The apparatus as claimed in claim 5, further comprising a valve for selectively controlling the exchange of the developer and which is installed between said settling unit and said vessel.

7. The apparatus as claimed in claim 1, wherein said developer input/output controller comprises:

a first valve which is selectively opened or closed such that the developer in said developing unit is moved into said settling unit: and a second valve which is selectively opened or closed such that the developer in said settling unit is returned to said developing unit.

8. The apparatus as claimed in claim 7, wherein said developer input/output controller further comprises a pump which is selectively operated to return the developer in said settling unit to said developing unit.

* * * * *